US008863978B2

(12) United States Patent
Przytulla et al.

(10) Patent No.: US 8,863,978 B2
(45) Date of Patent: Oct. 21, 2014

(54) PALLET CONTAINER

(75) Inventors: Dietmar Przytulla, Kerpen (DE); Klaus Peter Schmidt, Bonn (DE); Detlev Weyrauch, Kreuzau-Untermaubach (DE); Ernst Wurzer, Königswinter (DE)

(73) Assignee: Mauser-Werke GmbH, Brühl (DE)

( * ) Notice: Subject to any disclaimer, the term of this patent is extended or adjusted under 35 U.S.C. 154(b) by 0 days.

(21) Appl. No.: 13/122,229

(22) PCT Filed: Oct. 1, 2009

(86) PCT No.: PCT/EP2009/007052
§ 371 (c)(1),
(2), (4) Date: Apr. 1, 2011

(87) PCT Pub. No.: WO2010/037546
PCT Pub. Date: Apr. 8, 2010

(65) Prior Publication Data

US 2011/0180554 A1 Jul. 28, 2011

Related U.S. Application Data

(60) Provisional application No. 61/102,119, filed on Oct. 2, 2008.

(30) Foreign Application Priority Data

Oct. 2, 2008 (DE) ..... 20 2008 013 055 U

(51) Int. Cl.
*B65D 19/02* (2006.01)
*B65D 77/04* (2006.01)

(52) U.S. Cl.
CPC ..... *B65D 77/0466* (2013.01)
USPC ..... 220/660; 220/668; 220/485; 220/23.89; 220/23.87; 206/386; 206/405; 206/407

(58) Field of Classification Search
USPC ..... 220/1.5, 485, 619–620, 660, 678, 689, 220/9.1, FOR. 112–FOR. 113; 206/386, 600, 206/405, 407; 403/274, 285, 345
IPC .. B65D 19/00,19/02, 77/04; F16D 1/072; F16G 11/00
See application file for complete search history.

(56) References Cited

U.S. PATENT DOCUMENTS 470,514 A * 3/1892 Simspon ..... 403/285
4,809,999 A * 3/1989 Tozawa et al. ..... 280/281.1

(Continued)

FOREIGN PATENT DOCUMENTS

DE 195 11 723 C1 8/1996
DE 196 42 242 A 3/1998

(Continued)

*Primary Examiner* — Mickey Yu
*Assistant Examiner* — Brijesh V. Patel
(74) *Attorney, Agent, or Firm* — Henry M. Feiereisen LLC

(57) ABSTRACT

The present invention relates to a pallet container (10), with a thin-walled, rigid inner container (12) composed of thermoplastic material for the storage and transport of liquid or pourable contents, with a trellis tube support casing (14) tightly enclosing the plastic container (12), and with a base pallet (16), on which the plastic container (12) rests and to which the support casing (14) is rigidly connected, wherein the trellis tube support casing (14) is constructed of vertical and horizontal tubes (18, 20) that are welded to each other, with the peripheral horizontal tubes (18) being rigidly connected to each other. The connection of the horizontal tubes (18) is accomplished by a positive clinched joint (24) disposed on the inside of the horizontal tubes (18), wherein the outside of the horizontal tubes (18) is free from any clinched joint deformations.

8 Claims, 9 Drawing Sheets

(56) References Cited

U.S. PATENT DOCUMENTS

Figure 1:
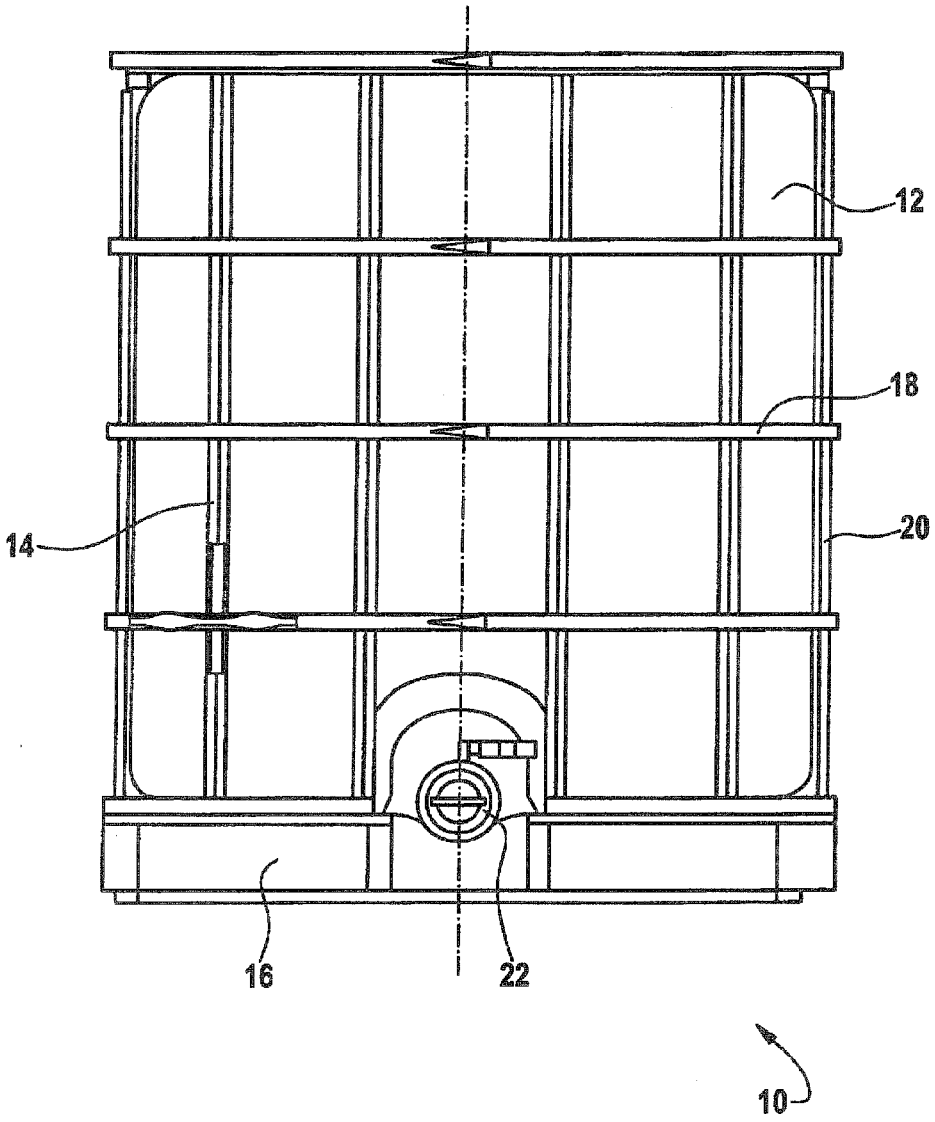

| | | | | |
|---|---|---|---|---|
| 4,947,988 | A * | 8/1990 | Schutz | 206/386 |
| 5,133,476 | A * | 7/1992 | Schutz | 220/622 |
| 5,405,006 | A * | 4/1995 | Burgdorf et al. | 206/386 |
| 5,645,185 | A | 7/1997 | Cassina | |
| 5,665,679 | A * | 9/1997 | McInnes | 504/164 |
| 5,678,688 | A | 10/1997 | Schutz | |
| 6,202,844 | B1 * | 3/2001 | Sedlmayr | 206/386 |
| 6,244,453 | B1 | 6/2001 | Maschio | |
| 6,276,111 | B1 * | 8/2001 | Pittman et al. | 403/205 |
| 7,399,942 | B2 * | 7/2008 | Wang et al. | 219/93 |
| 2002/0112980 | A1 * | 8/2002 | Przytulla | 206/386 |
| 2004/0195242 | A1 * | 10/2004 | Przytulla | 220/495.01 |

FOREIGN PATENT DOCUMENTS

| | | | |
|---|---|---|---|
| DE | 297 19 830 | U1 | 6/1998 |
| EP | 0 734 967 | A | 10/1996 |
| EP | 1 939 108 | A1 | 7/2008 |

* cited by examiner

PALLET CONTAINER

The invention relates to a pallet container with a thin-walled, rigid inner container constructed of a thermoplastic material for storing and transporting liquid or pourable contents, with a trellis tube support casing tightly enclosing the plastic container, and with a base pallet, on which the plastic container rests and to which the support casing is rigidly connected. The trellis tube support casing (outer container) of the pallet container is constructed of vertical and horizontal tubes that are welded to each other, wherein the peripheral horizontal tubes are rigidly connected to each other. In order to obtain a closed outer container, the peripheral horizontal tubes are connected to each other at least one location.

STATE OF THE ART

Such pallet containers with a welded trellis tube support casing are generally known, for example from EP 0 734 967 A. The trellis tube support casing of the top container disclosed therein is constructed from a round tube profile which is severely compressed at the welded intersecting locations. DE 297 19 830 U1 discloses a different pallet container having trellis rods with a tube profile other than a circular cross section, which is explicitly designed to have a uniform cross-section along its entire length without any indentations or depressions that would reduce the cross-section. Another pallet container with a trellis tube support casing made of open profile rods is disclosed in DE 196 42 242 A. In addition, various other containers with a square trellis rod cross-section are disclosed in the state-of-the-art. The trellis tube support casing is typically attached to the base pallet, which can be implemented as a flat pallet made of plastic, wood, sheet-metal or parts thereof with a tubular steel frame (composite pallet), by way of fastening means, such as screws, clips, clams or claws, that grip over or through the lower horizontal trellis frame tube. The fastening means are nailed, attached with pins, screwed or welded on the top plate or the upper outer edge of the pallet. With steel pallets, the trellis tube casing is directly welded. For industrial applications or applications of the pallet containers in the chemically industry, the pallet containers must go though a regulatory permit process and meet various quality criteria. For example, interior pressure tests as well as drop tests with filled pallet containers from different heights are performed. Pallet containers or combination IBC's (IBC=Intermediate Bulk Container) of the aforedescribed type—in lightweight construction without massive corner support posts having a tare weight of about 62 to 80 kg for a 1000 liter IBC, depending on the type of pallet—are preferably employed for transporting liquids. In particular when transporting filled combination IBC's by truck, the liquid contents is exposed to strong acoustic vibrations due to the bumps during transport and the movement of the transport vehicle—in particular under poor road conditions—, which produces continuously changing pressure forces on the walls of the inner container, which in turn causes radial oscillations of the trellis tube support casing with rectangular pallet containers (permanent dynamic oscillation load). Depending on the design of the trellis tube support casing, the stress during longer transport on bad roads becomes so large that the welds in the intersecting regions and even individual rods of the trellis can fatigue and break.

The peripheral tube connections of the horizontal tubes of the trellis tube support casing represent in particular under transport stress and during certification tests (vibration test oval one hour with subsequent inner pressure test of about 100 kPa for 10 minutes) a particular location where fatigue fractures or even tube fractures may preferably occur. The horizontal and vertical tubular rods of the presently most widely used combination IBC's have a circular or square tube cross-section.

With the horizontal tube connections, one side of a tube is made smaller and inserted into the other open tube end to a depth of about 50 mm, whereafter the joint is finish-processed in different ways. With the known pallet containers with circular cross section of the trellis rods (U.S. Pat. No. 5,678,688) finish-processing is performed horizontally from the inside; the tube connection is radially compressed from the inside so that the rear tube half makes flush contact with the inside of the front tube half upon insertion. Holding tongues/holes are punched into the fourfold wall of this tube connection from the outside.

In another conventional pallet container with a square tube cross-section (U.S. Pat. No. 5,645,185), after insertion of the inner tube end, the outer tube end is provided with several peripheral chamfers which are pressed into the angled corner regions of the tube cross-section. In addition, with the most highly stressed tube connections, fastening screws are employed for reinforcement.

In another conventional pallet container with square cross-section (U.S. Pat. No. 6,244,453) the outer half of the tube connection is compressed along a predetermined length in the vertical direction and clinched against each other in an undulating pattern. The inner half of the tube connection hereby retains its shape. In order to withstand tensional stress, for example during the internal pressure test, the clinching engagement must be implemented comparatively deeper and/or with sharp edges, so that there may be a risk of excess material stress at this exterior location under typical stress situations. All conventional tube connections are typically centered in a line on top of one another in the trellis wall of the trellis tube support casing, in which the withdrawal fitting for the liquid contents is disposed at the center in the bottom region of the plastic inner container.

Object to be Solved

It is an object of the present invention to obviate the disadvantages of the prior art and to provide an improved tube connection without additional fastening means, such as screws, wherein the tube connection has improved resistance, in particular against dynamic vibration stress (e.g., vibration test with subsequent interior pressure test) and longer vibration stress with simultaneous stacking stress (e.g., transport stress).

Solution

The object is solved in that the connection of the horizontal tubes is made with a positive clinched joint arranged on the inside of the horizontal tubes, wherein the outside of the horizontal tubes is free from any kind of deformation. The clinched joint is implemented only on the inner half of the horizontal tubes in form of a meshing, undulating, positive connection in form of a vertical indentation from above and below produced with corresponding pressing dies. By arranging the positive clinched joint of the horizontal tubes according to the invention in the connecting region on the inside, only the inner half of the tube ends is deformed, whereas the other half of the horizontal tubes with a square tube cross-section is free from any kind of deformation. Because any cold forming, such as a clinched joint, causes an increase in the rigidity of the material structure, this also implies a simultaneous decrease of the previous elasticity. The material accumulation establishing the positive joint and mutual support of the upper and lower sides of the tube (double tube) also stiffens the tube.

In a vibration test, all side walls of the trellis frame oscillate elastically, alternatingly inwardly and outwardly from their normal planar position, due to the movement of the liquid contents. The elastic deformation of the side walls is greatest in the center region, where the outward "bulging" is about twice as large as the inward "bulging." As a result, the outside of the horizontal rods is subjected during an outward deformation to approximately twice the tension force than the inside of the horizontal rods during an inward deformation. Tension forces are, unlike compression forces, in particular with dynamically changing pressure loads, extremely critical and can damage the material when they exceed a defined magnitude. They cause cracks mostly at the transition points where the cross-section of the tubes changes. Advantageously, with the tube connection constructed according to the invention, the undeformed outer half of the horizontal tubes is in a region of greater bending (outwardly) with higher tension forces, whereas the inner half of the horizontal rods with positively clinched joints (and higher stiffness with lower elasticity) is in a region with smaller rod bending (inwardly) with lower tension forces.

In this way, a supporting connection is produced which does not require additional components, such as screws, and which has a significantly higher stability under load and resistance against alternating bending stress and in particular against long-term dynamic vibration-induced stress.

Additional modified embodiments according to the invention are as follows:

In a modified embodiment of the invention, the arrangement of the tube connection with a clinched joint of the horizontal tubes of the trellis tube support casing may have alternatingly different insertion directions at the same peripheral position. With a horizontal rod, the tube end on the right side is made smaller and inserted into the tube end on the left side, whereas for the next horizontal rod, the tube end on the left side is made smaller and inserted into the tube end on the right side, etc. In this way, the connecting region can be made uniform, without having a preferred insertion direction.

In another embodiment of the invention, the tube connection of the horizontal trellis tubes can be arranged off-center and superpositioned along a line in a side wall of the trellis tube support casing. Because the greatest deformation occurs in the center of the trellis walls, this advantageous approach moves the clinched joints of the tubes to regions with lower peak stress.

In another embodiment of the invention, the tube connection of the horizontal trellis tubes may be arranged off-center and superpositioned alternatingly in a side wall of the trellis tube support casing. Because the clinched joint of the horizontal tubes in the connecting region always increases the stiffness at this location, this modified embodiment results in more uniform elastic properties of the entire side wall with the connecting region compared to the other side walls of the trellis frame without the connecting regions of the horizontal rods.

Advantages

The arrangement of the tube connections of the horizontal tubes of the trellis tube support casing towards the inside in the direction of the inner container improves resistance against long-term alternating bending stresses;

The arrangement of the tube connections of the horizontal tubes of the trellis tube support casing towards the inside in the direction of the inner container is visually more appealing, because the undulating clinched joints are not visible when viewed or directly observed from the outside;

Cracking of the horizontal tubes at the clinched joints as a weak notched point on the outside is prevented, because the tube connections are now located in the interior region of the sustainable tension forces of alternating bending stresses, which typically occur during long transports and vibration testing.

In one embodiment of the invention, the clinched joints are no longer arranged in the central region of a side wall (=the region with the greatest bending), but instead in an off-center region of the side wall. Moving the tube connections to off-center regions of the side walls of the trellis tube support casing has the significant advantage in that the side walls bend less at that location and have lower peak values of alternating tension/compression stresses.

The outer or outside cross-sectional regions of the horizontal rods (with the highest tension stress) are preferably not deformed in the outer tubes (which are pushed over the inserted other tube end in the connecting region) by the clinched joints, and the outside of the inner tube is deformed only in the longitudinal direction, so that the inner tube regions (with the clinched deformation) are predominantly subjected to harmless compression stress.

Figure 2:
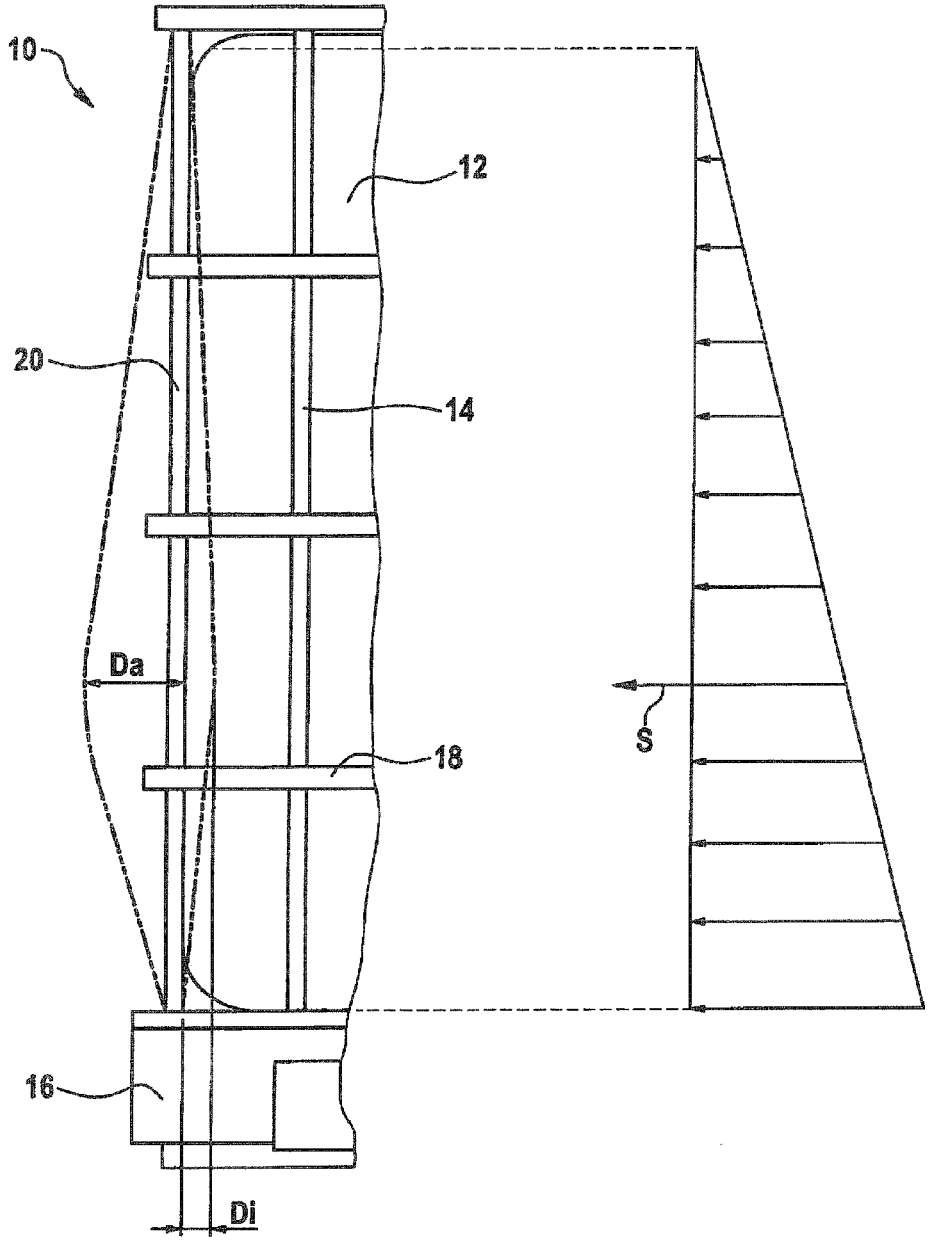
Figure 3:
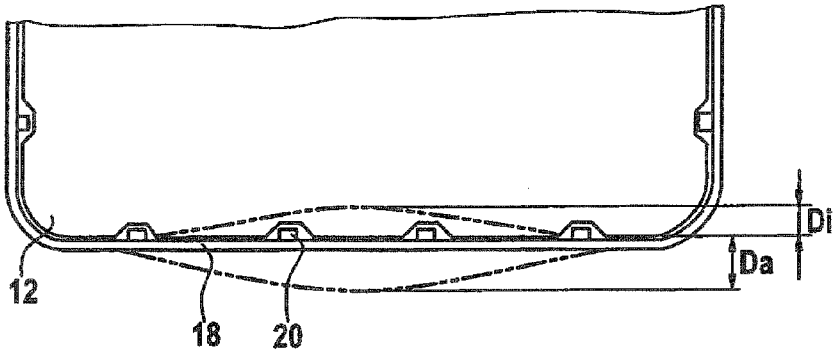
Figure 4:
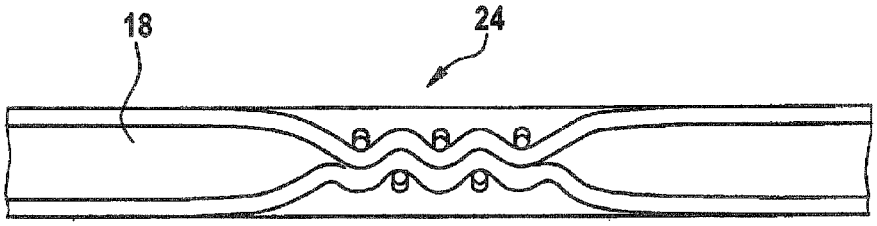
Figure 5:
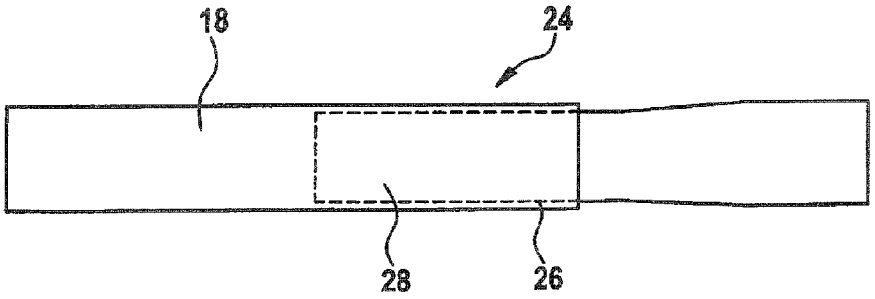
Figure 6:
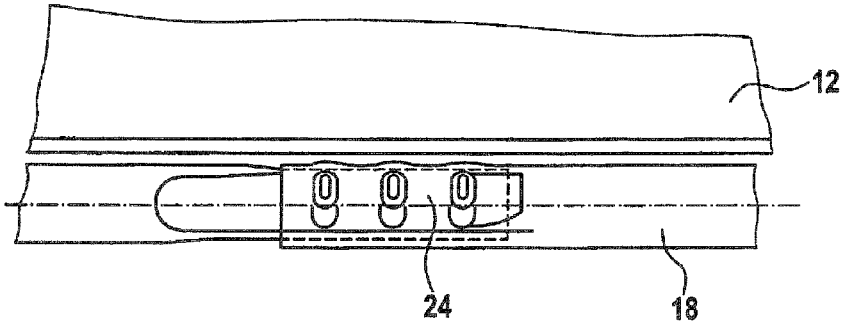
Figure 7:
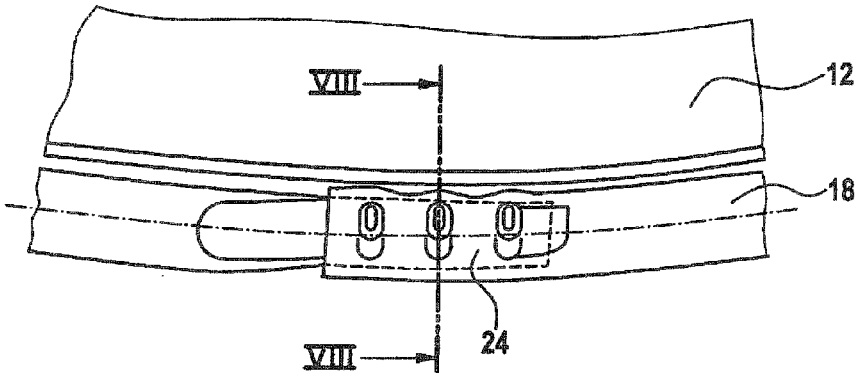
Figure 8:
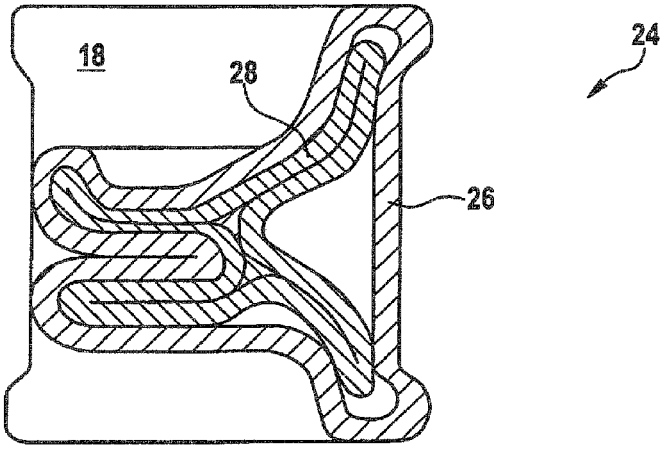
Figure 9:
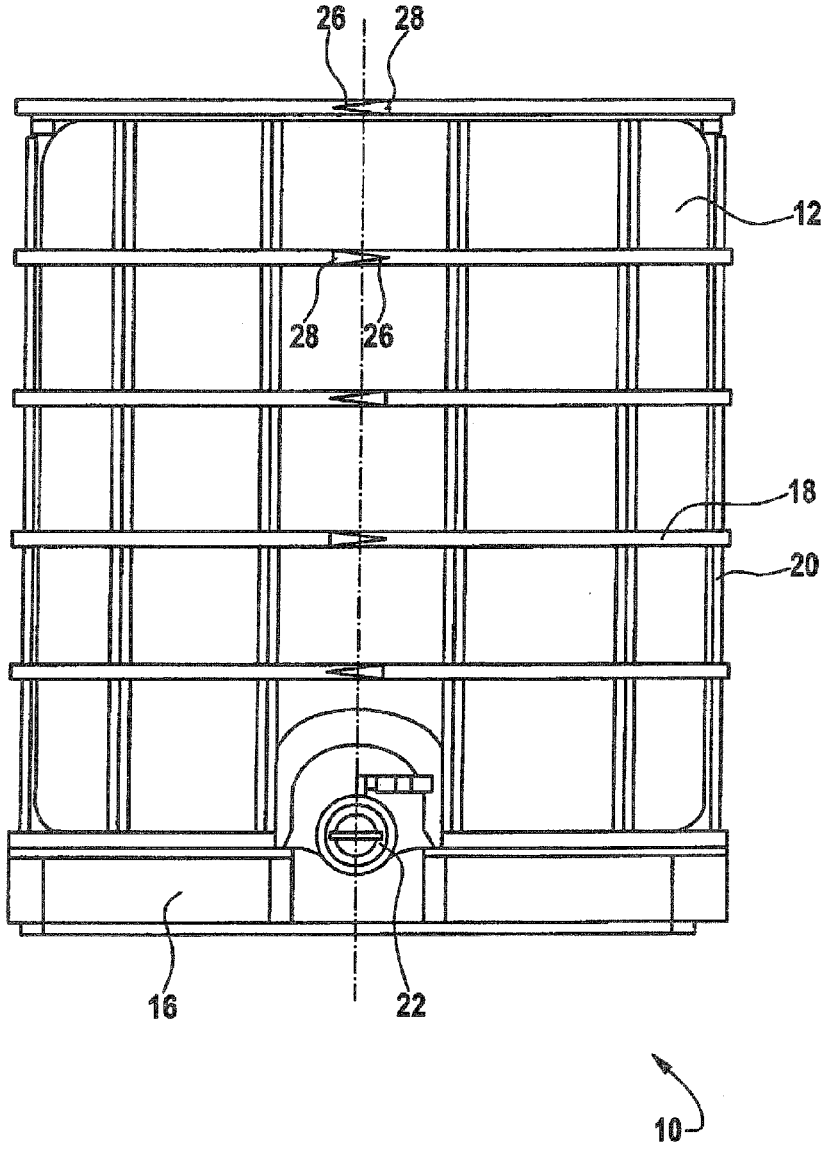
Figure 10:
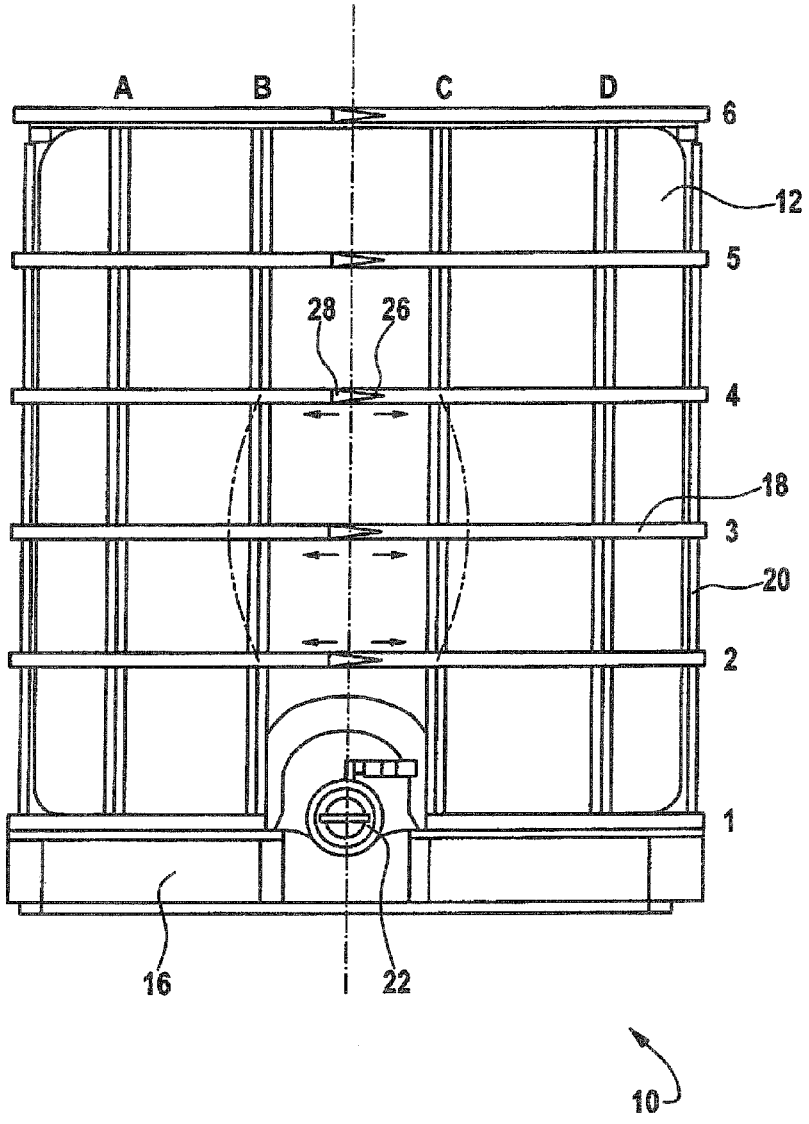
Figure 11:
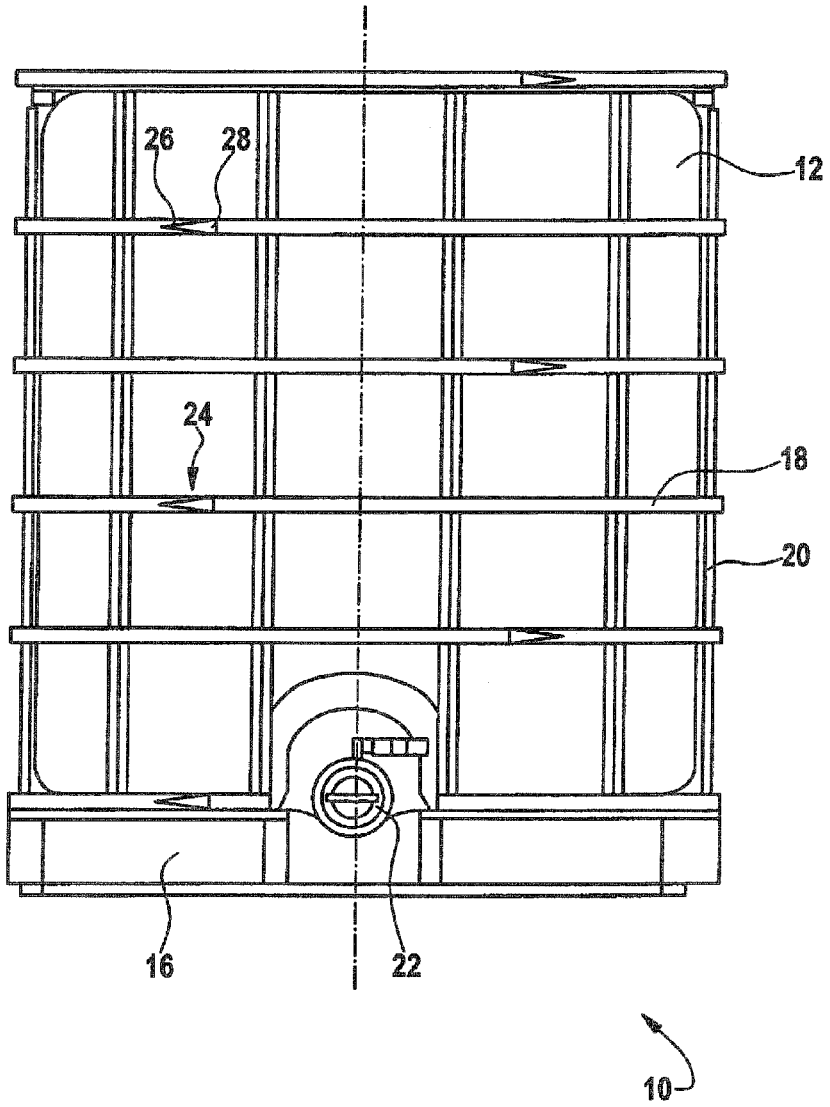
Figure 12:
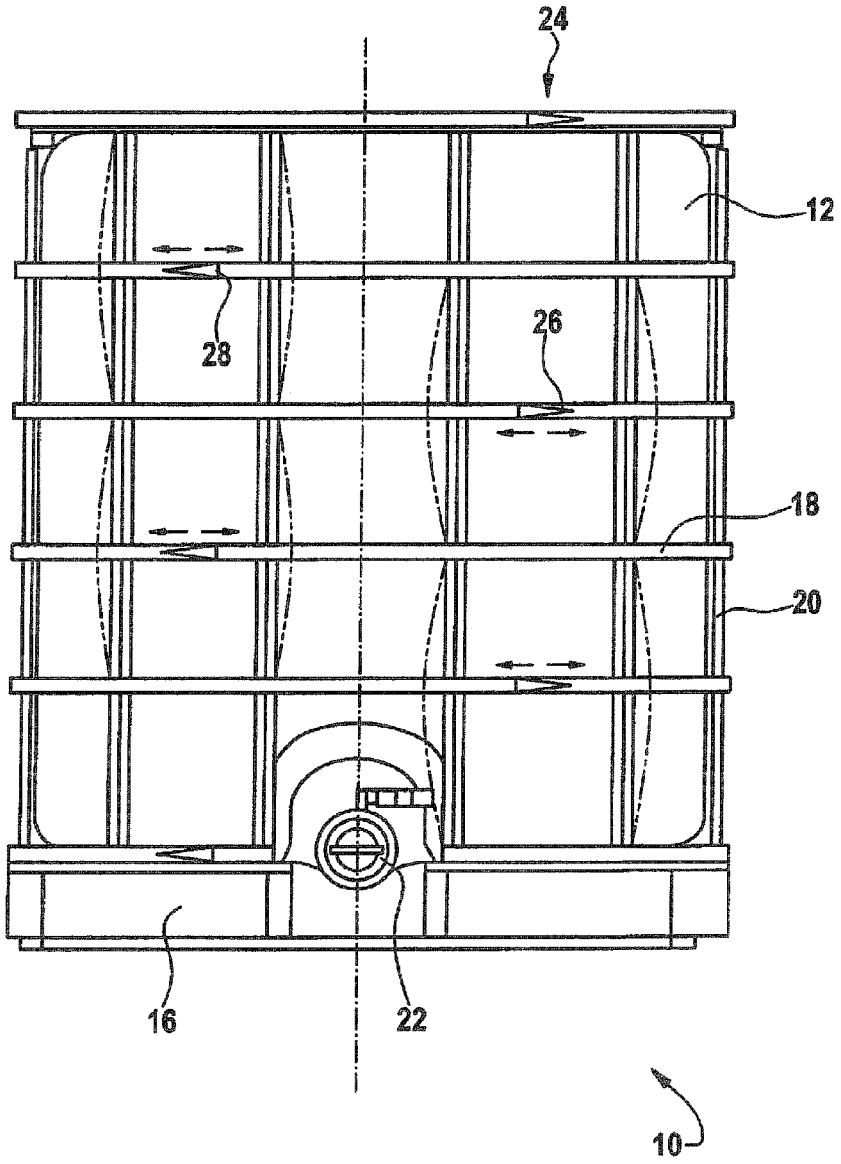
Figure 13:
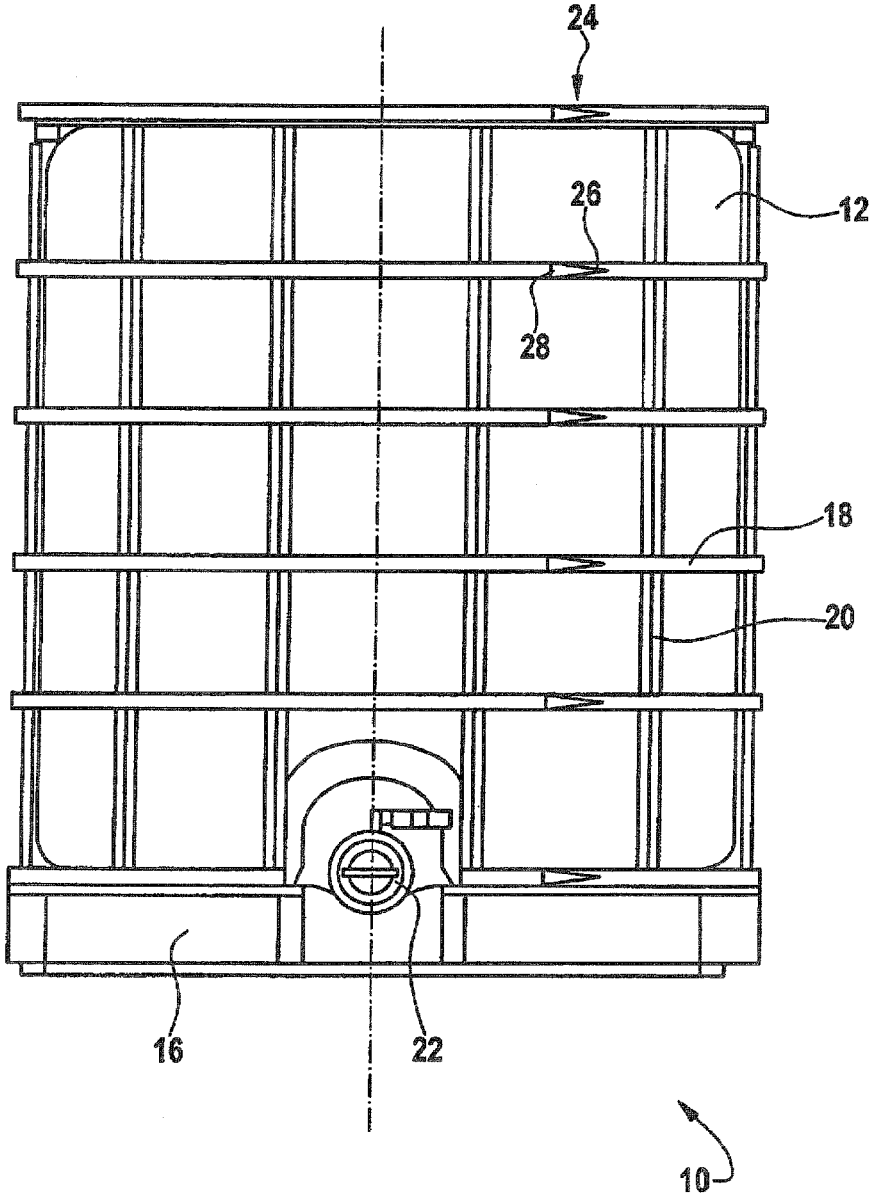

The invention will now be described in more detail with reference to exemplary embodiments schematically shown in the drawings, where:

FIG. 1 shows a pallet container according to the invention,

FIG. 2 shows in a partial view the elastic deformation of the trellis tube support casing under transport stresses, FIG. 3 shows the deformation of the trellis tube support casing in a top view onto the trellis wall, FIG. 4 shows the region of the clinched joint of a horizontal tube from the inside, FIG. 5 shows the region of the clinched joint of a horizontal tube from the outside, FIG. 6 shows the region of the clinched joint of a horizontal tube, as viewed from above, with the inner container in a static resting state, FIG. 7 shows the region of the clinched joint of a horizontal tube with the inner container in a state undergoing an outward deformation, also viewed from above, FIG. 8 shows a section through the connecting region (clinched joint) according to FIG. 7, FIG. 9 shows another modified embodiment of the pallet container according to the invention with clinched joints arranged in different directions, FIG. 10 shows the principle of crack propagation during an interior pressure test with clinched joints at the same peripheral position, FIG. 11 shows another modified embodiment of the pallet container according to the invention with clinched joints at different positions, FIG. 12 shows the principle of crack support in a trellis tube support casing with clinched regions having different peripheral positions, and FIG. 13 shows another modified embodiment of the pallet container with clinched regions disposed at locations having small alternating bending stresses.

FIG. 1 shows with the reference numeral 10 a pallet container according to the invention, with a thin-walled rigid inner container 12 made out of thermoplastic material for storing and transporting, in particular, dangerous liquid contents, with a trellis tube support casing 14 tightly enclosing the plastic container 12, and with a base pallet 16, on which the plastic container 12 rests and to which the support casing 14 is rigidly connected. The trellis tube support casing 14 (outer container) of the pallet container 10 is constructed from vertical and horizontal tubes 18, 20 that are welded to each other. In order to attain a closed outer container, the peripheral horizontal tubes 18 are connected to each other.

The connecting region of the horizontal tubes 18 are—as is customary—located at the center of one of the two shorter side walls of the pallet container 10 exactly above the withdrawal fitting 22 which is connected at the center in the base region of the inner container 12. In the present example, the arrow tips shown in the horizontal tubes 18 and pointing to the left indicate that the tube end on the right is made smaller and inserted into the unchanged tube end on the left. The clinched joint of the horizontal tubes is implemented on the inside and is therefore not visible from the outside.

To reduce the cross-section of one tube end for insertion into the other tube end, the previously undeformed, mutually parallel pairs of side walls of the square cross section of the tube end to be inserted are pressed inwardly along a length of about 50 mm, producing an approximately X-shaped tube cross-section, wherein the corners of the X-shaped tube cross-section are pulled slightly inwardly, so that they can be pushed into the undeformed square tube cross-section of the other tube end.

To explain the elastic bending characteristic of side walls of a pallet container 10 during transport stresses, FIG. 2 shows schematically that maximum bending of the trellis tube walls occurs at the location of the mass center of gravity "S" of a filled pallet container and is located at a height of approximately 33% of the height of the side wall—as measured from the pallet 16—, wherein the outward bending "Da" is approximately twice as large as the inward bending "Di". The top view of FIG. 3 shows that maximum bending occurs always at the center of a side wall.

FIG. 4 shows in a top view the connecting region according to the invention disposed inside of a horizontal tube 18, namely the inside clinched joint of the horizontal tube 18. Three pincing jaws of the clinching tool were hereby pressed downward from above and four pincing jaws with an offset were pressed upward from below into the lower half of the horizontal tube 18, thereby producing a fixed, non-releasable, undulating positive connection between both tube ends 26, 28.

Similarly, FIG. 5 shows the same connecting region of the horizontal tube 18 of FIG. 4. As clearly seen, the outside of the outer tube end 26 is free from clinch deformations and hence also free from any kind of indentations.

FIG. 6 shows in a partial cross-sectional top view the connecting region of a horizontal tube 18 with a plastic container 12 abutting on the inside in a static rest state. The side wall of the pallet container has practically no bending. Conversely, FIG. 7 shows the same connecting region in a state of a wave stress by liquid contents swapping back and forth with corresponding outward bending of the side wall. FIG. 8 shows a cross-section of the clinched joint region 24 taken along the line VIII-VIII. As seen on the left side, the two tube ends 26, 28 are positively clinched with each other. The outer wall of the outer tube 26 on the right side of the illustration is completely free from deformations. This undeformed outer wall, which still has its original high elasticity (unlike the clinched regions which are stiffened by cold forming and have reduced elasticity), absorbs the highest critical tension forces without suffering damage. The undulating positive connection according to the invention exclusively on the inside of the horizontal tubes represents, unlike other tube connections (with screws and screw holes, or punched hook eyelets), an optimal solution because the material is only folded without tearing or breaking through the material structure, which generally represents a nucleus for crack formation.

FIG. 9 shows a modified embodiment where the two tube ends 26, 28 of the horizontal trellis tubes are alternatingly inserted into one another and clinched. In one horizontal tube, the left tube end is made smaller (=tip of the arrow) and inserted into the right undeformed tube end, whereas in the next horizontal tube the tube connection is implemented in reverse.

FIG. 10 shows crack formation at a critical tube connection and a subsequent tearing of adjacent clinched joints. Typically, crack formation starts at a location with the highest stress. This is typically in the center region of the horizontal rod No. 3 (second from below) between the vertical rods B and C. If a clinched joint in rod 3 is torn or completely broken apart, then additional stress is introduced in the clinched joints of the horizontal rods 4 and 2 via the rods B and C, which are then torn apart at their connecting region as a result of the additional stress due to the malfunction of the torn tube connection.

FIG. 11 shows another advantageous arrangement of the clinched joints according to the present invention at different peripheral positions. The tube connections are arranged alternatingly off-center in the trellis wall, with one offset to the right side and one offset to the left side. In such a modified embodiment, the torn-apart clinched joints do not transmit tension forces to adjacent clinched joints and therefore no tension forces need to be absorbed by those joints.

FIG. 12 shows for this modified embodiment that a break in a tube—should such break occur at this location—is relatively uncritical, because the other adjacent to connections are not additionally stressed and hence overloaded in the event of a malfunction of a broken tube connection. The reason is that each tube connection is enclosed all-around by six respective rigidly welded intersecting locations of vertical and horizontal trellis rods and located in a trellis field (trellis rectangle) where the adjacent horizontal tubes do not include a tube connection. Conversely, the tube connections of the adjacent horizontal rods are always arranged in a trellis field that is farther removed, so that bending stresses of a broken tube connection cannot be transferred directly to the next tube connection and apply stress at this connection.

Lastly, FIG. 13 shows an exemplary embodiment where the tube connections 24 are arranged in the front side wall of the pallet container 10 on top of one another, but off-center. The tube connections 24 can be provided on the right side or on the left side from the center of the side wall (exactly above the withdrawal fitting 22). They are then located in a region of small bending and are also no longer subjected to the high critical tension stresses. In summary, the present invention teaches how the resistance of any trellis frame for a pallet container with welded horizontal and vertical tubes having a square tube cross-section against dynamic permanent vibration stress can be improved or increased in a very simple manner.

LIST OF REFERENCES SYMBOLS

10 Pallet container
12 Plastic container
14 Trellis tube support casing
16 Base pallet
18 Horizontal trellis tube (14)
20 Vertical trellis tube (14)
22 Withdrawal fitting (12)

24 Connecting region—clinched joint (18)
26 Outside tube end (24)
28 Inside tube end (24)

The invention claimed is:

1. A pallet container, comprising:

a thin-walled, rigid inner container constructed of a thermoplastic material for storing and transporting liquid or pourable contents, a base pallet supporting the inner container, and a trellis tube support casing rigidly connected to the base pallet and tightly enclosing the inner container, said trellis tube support casing constructed of vertical tubes and peripheral horizontal tubes that are welded to the vertical tubes and have a rectangular cross section with four sidewalls, wherein each of the peripheral horizontal tubes comprises a positive-locking clinched joint that is formed by a crimped first end section having an approximately X-shaped reduced tube cross-section and a second end section surrounding the crimped first end section along an overlap extending in the peripheral direction of the respective peripheral horizontal tube, wherein at the positive-locking clinched joint, a top sidewall and a bottom sidewall of the second end section are deformed along the overlap against the approximately X-shaped reduced tube cross-section of the first end section so as to form the positive-locking clinched joint with the approximately X-shaped reduced tube cross-section, whereas an outer sidewall of the second end section remains in its original state and is thus free from deformation resulting from the positive-locking clinched joint along the overlap.

2. The pallet container of claim 1, wherein the positive-locking clinched joint comprises top depressions formed on the top sidewall and bottom depressions formed on the bottom sidewall of the second end section, said top and bottom depressions propagating into the first end section, thereby forming an interlocking non-releasable positive connection between the first end section and the second end section.

3. The pallet container of claim 2, wherein the top depressions and the bottom depressions are offset from each other in the peripheral direction of the peripheral horizontal tube.

4. The pallet container of claim 2, wherein the top depressions and the bottom depressions are consecutively arranged on the respective top sidewall and the bottom sidewall and form a respective wavy top and bottom surface structure in the peripheral direction.

5. The pallet container of claim 1, wherein the positive-locking clinched joints of different peripheral horizontal tubes are located at an identical peripheral position of the trellis tube support casing, with the different peripheral horizontal tubes having different alternating insertion directions at the identical peripheral position.

6. The pallet container of claim 1, wherein the positive-locking clinched joints of different peripheral horizontal tubes are arranged off-center in a side wall of the trellis tube support casing and stacked on top of one another in a line pattern.

7. The pallet container of claim 1, wherein the positive-locking clinched joints of different peripheral horizontal tubes are arranged off-center in a side wall of the trellis tube support casing and stacked on top of one another in an alternating pattern.

8. The pallet container of claim 2, wherein a depth of the top depressions and the bottom depressions increases in the peripheral direction of the respective peripheral horizontal tube towards a center of the positive-locking clinched joint and decreases laterally outwardly from the center.

* * * * *